United States Patent [19]

Yamamoto et al.

[11] Patent Number: 4,791,455

[45] Date of Patent: Dec. 13, 1988

[54] COLOR ELECTROPHOTOGRAPHIC APPARATUS AND METHOD OF CLEANING A PHOTOSENSITIVE MEDIUM

[75] Inventors: Hajime Yamamoto, Ibaraki; Hidenori Kunishige, Yawata; Yuji Takashima, Nishinomiya, all of Japan

[73] Assignee: Matsushita Electric Industrial Co., Ltd., Osaka, Japan

[21] Appl. No.: 14,691

[22] Filed: Feb. 10, 1987

[30] Foreign Application Priority Data

| | | | |
|---|---|---|---|
| Feb. 13, 1986 | [JP] | Japan | 61-29243 |
| Apr. 3, 1986 | [JP] | Japan | 61-77151 |
| Aug. 29, 1986 | [JP] | Japan | 61-204106 |
| Oct. 2, 1986 | [JP] | Japan | 61-234817 |

[51] Int. Cl.[4] ..... E03G 15/08

[52] U.S. Cl. ..... 355/15; 355/3 DD; 430/125; 118/652

[58] Field of Search ..... 355/15, 3 DD, 4; 118/652; 430/125

[56] References Cited

U.S. PATENT DOCUMENTS

| | | | |
|---|---|---|---|
| 4,348,103 | 9/1982 | Kawazu et al. | 355/15 |
| 4,416,533 | 11/1983 | Tokunaga et al. | 355/4 |
| 4,449,241 | 5/1984 | Nakayama | 118/699 |
| 4,515,467 | 5/1985 | Suzuki | 355/15 |
| 4,530,596 | 7/1985 | Kawamoto et al. | 355/15 |
| 4,571,071 | 2/1986 | Bothner | 355/42 |
| 4,664,505 | 5/1987 | Itaya et al. | 355/15 |

FOREIGN PATENT DOCUMENTS

| | | |
|---|---|---|
| 0193274 | 9/1986 | European Pat. Off. . |
| 3524159 | 1/1986 | Fed. Rep. of Germany . |

OTHER PUBLICATIONS

Suzuki, Yoshirou; "Cleaning Device of Electrophotographic Device", Patent Abstracts of Japan, vol. 8, No. 31, Feb. 9, 1984.

Doi, Masaaki; "Cleaning Device", Patent Abstracts of Japan, vol. 9, No. 250, Oct. 8, 1985.

Tamagawa, Youichi; "Image Forming Device", Patent Abstracts of Japan, vol. 9, No. 259, Oct. 17, 1985.

Ootsuka, Hiroshisa; "Cleaning Device", Patent Abstracts of Japan, vol. 6, No. 46, Mar. 24, 1982.

Fujimura, Yoshihiko; "Magnetic Brush Type Developing and Cleaning Device", Patent Abstracts of Japan, vol. 9, No. 116, May 21, 1985.

Takano, Toshimasa, "Cleaning Device for Forming Surface of Latent Image", Patent Abstracts of Japan, vol. 6, No. 188, Sep. 28, 1982.

*Primary Examiner*—A. C. Prescott

*Attorney, Agent, or Firm*—Spencer & Frank

[57] ABSTRACT

A cleaning device for use in a color electrophotographic apparatus in which a photosensitive medium is made to rotate for a plurality of times so as to conduct repetitional cycles each including charging, exposure and development, thereby forming toner images of different colors on the photosensitive medium. The cleaning device comprises a conductive fur brush for cleaning the surface of the photosensitive medium so as to remove any toner remaining on the surface of the photosensitive medium; and a driving mechanism for placing the fur brush in contact with the photosensitive medium during cleaning and for keeping the same away from the photosensitive medium when the cleaning is not conducted. The cleaning device effectively prevents any part of the toner after the transfer from remaining on the surface of the photosensitive medium.

17 Claims, 6 Drawing Sheets

COLOR ELECTROPHOTOGRAPHIC APPARATUS AND METHOD OF CLEANING A PHOTOSENSITIVE MEDIUM

BACKGROUND OF THE INVENTION

The present invention relates to a cleaning device which can be applied to an apparatus for producing hard copies of color images such as color copiers, color printers and so forth. The invention also is concerned with a multi-color printing apparatus which incorporates the cleaning device.

Hitherto, various electrophotographic methods have been proposed in which a series of operations including steps for charging, exposure and development is conducted cyclically so as to form a plurality of toner images of different colors on an electrophotographic photosensitive medium and these toner images are transferred at once onto a sheet of paper thus obtaining a hard copy of a color image.

FIG. 1 schematically shows a known color electrophotographic apparatus of a type which is disclosed in Japanese Patent Laid-Open No. 95456/1985. This apparatus has a photosensitive medium 1 made of a selenium-tellurium (Se—Te) alloy and adapted to rotate in the direction shown by an arrow, a corona charger 2 for electrostatically charging the photosensitive medium, a laser beam scanner 3, developing units 4 to 7 which accommodate toners of yellow (Y), magenta (M), cyan (C) and black (Bk) respectively. A reference numeral 8 denotes a sheet of paper on which a copy image is to be formed. The apparatus further has a charge-eliminating lamp 9, a corona transfer device 10, a toner fusing device 11, a cleaning blade 12 and a charge eliminating lamp 13 for initializing the surface potential of the photosensitive medium after the transfer.

In operation, the photosensitive medium 1 is positively charged by the corona charger 2, and a scanning exposure is conducted by means of the laser beam scanner 3 so as to expose the medium to the yellow picture signal, thus forming a negative electrostatic latent image. More specifically, the portions of the area on the photosensitive medium corresponding to the picture and line portions of the original image are exposed so that the surface potential is attenuated in these portions. The electrostatic latent image thus formed is then inverted and developed by the developing unit 4 which contains the yellow toner Y, whereby an yellow toner image is formed on the photosensitive medium 1. During this development, only the developing unit 4 containing the yellow toner is connected to an electric power supply, while other developing units 5 to 7 are inoperative. Then, the whole area of the photosensitive medium is irradiated with light from the charge eliminating lamp 13, so that the electrostatic latent image for the yellow color is extinguished.

Then, the process including charging, exposure, development and charge elimination by light which are the same as those explained in connection with yellow color is conducted repeatedly for each of the magenta, cyan and black colors. Toner images of yellow, magenta, cyan and black colors are thus formed on the photosensitive medium 1. After the formation of the toner images, the electrostatic latent images are neutralized by the charge eliminating lamp 9, and these toner images are transferred onto an ordinary sheet of paper by means of the corona charger 10. The toner images transferred to the paper are then fixed by application of heat by means of the toner fusing device 11. After the transfer of the toner images, toner particles remaining on the photosensitive medium 1 are removed by the cleaning blade 12, so that the photosensitive medium becomes ready for the formation of the next image.

The known apparatus shown in FIG. 1 suffers from a disadvantage in that the purities of colors of the copy image are degraded as the number of the printing cycles grow large, due to the fact that the toners of respective colors in the developing units are contaminated by the toners of different colors.

The present inventors have made an intense study to clarify the cause of the contamination of the toners, and reached a conclusion which will be explained hereinunder with reference to FIG. 2A.

In FIG. 2A, a cleaning blade 14 is held in contact with the photosensitive medium 15 so as to clean the surface of the photosensitive medium while collecting the toner particles. In this state, a bulk 16 of toner, which is about 2 mm thick and 5 mm wide, is formed on the end of the cleaning blade 14.

As will be seen from FIG. 2B, the cleaning blade 14 is moved away from the photosensitive medium 15 when the image is to be formed on the photosensitive medium 15. However, the bulk 16 of the toner possibly remains on the surface of the photosensitive medium 15 so tha it is conveyed to the developing unit 17 so as to contaminate the toner in this developing unit.

From this fact, it will be understood that a color process which employs a photosensitive medium on which color toner images are directly formed and synthesized essentially requires a cleaning device which does not leave any part of the toner on the photosensitive medium when cleaning device is moved away from the photosensitive medium.

SUMMARY OF THE INVENTION

Accordingly, an object of the present invention is to provide a cleaning device which is improved in such a way that no bulk of toner is left on the photosensitive medium when the cleaning device is moved away from the photosensitive medium.

To this end, according to one aspect of the present invention, there is provided a cleaning device for use in a color electrophotographic apparatus in which a photosensitive medium is made to rotate for a plurality of times so as to conduct repetitional cycles each including charging, exposure and development, thereby forming toner images of different colors on the photosensitive medium, the cleaning device comprising:

a conductive fur brush for cleaning the surface of the photosensitive medium so as to remove any toner remaining on the surface of the photosensitive medium; and a driving mechanism for placing the fur brush in contact with the photosensitive medium during cleaning and for keeping the same away from the photosensitive medium when the cleaning is not conducted.

DESCRIPTION OF THE PREFERRED EMBODIMENTS

Figure 1:
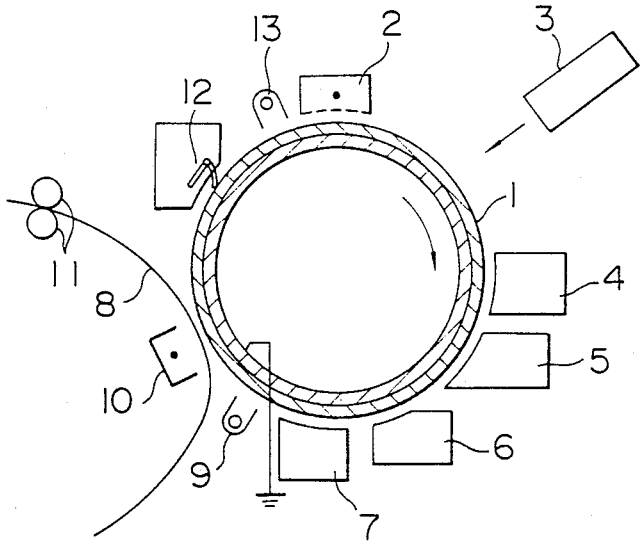
FIG. 1 PRIOR ART
FIG. 1 is a schematic illustration of a known color electrophotographic apparatus.
Figure 2A:
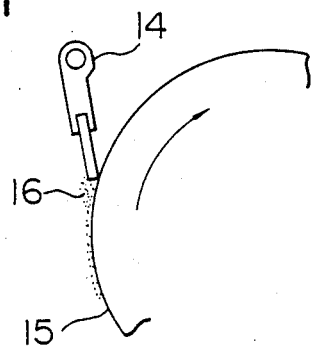
FIG. 2A PRIOR ART
FIGS. 2A and 2B are illustrations of operation of the known apparatus illustrating problems which are encountered by the known apparatus.
Figure 2B:
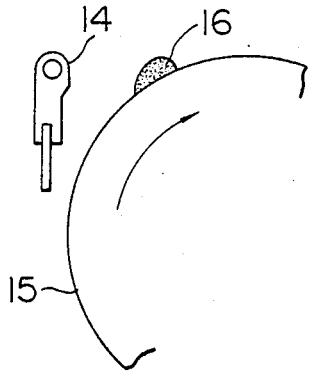
FIG. 2B PRIOR ART
Figure 2C:
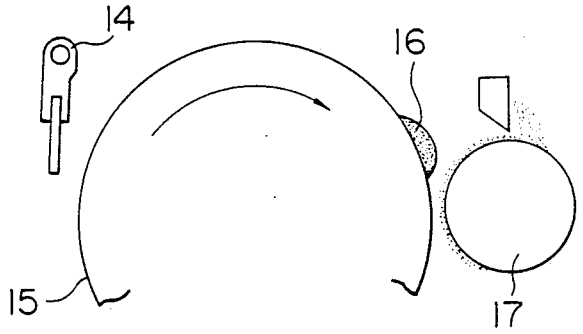
FIG. 2C PRIOR ART

As stated before, the known color electrophotographic apparatus incorporating a blade-type cleaning device encounters a problem in that a bulk of the toner remains on the photosensitive medium after the cleaning device is moved away from the photosensitive medium. This imposes a serious problem particularly in systems in which a color copy image is obtained by directly superposing toner images on the photosensitive medium, because the bulk of toner remaining on the photosensitive medium causes contamination of the respective toners due to mixing of toners of different colors. According to the invention, a voltage of a polarity reverse to the charging polarity of the toner is applied to a conductive fur brush so that the fur brush electrostatically attracts and adsorbs the toner. As a consequence, the toner is completely removed from the surface of the photosensitive medium without remaining on the medium surface.

When the cleaning device of the invention is used in a printing apparatus which is intended for a long operation, the apparatus is preferably equipped with a toner collecting roller which is adapted to collect the toner from the fur brush. During suspension of the cleaning operation, i.e., when the fur brush is kept away from the photosensitive medium, the fur brush is held in contact with the toner collecting roller so that the brush and the roller rotate while a potential difference large enough to cause the toner to be transferred to the toner collecting roller is developed between the fur brush and the collecting roller.

According to this arrangement, it is possible to obtain a time for the recovery of the cleaning power of the fur brush which is 2 to 4 times as long as the period over which the fur brush is held in contact with the photosensitive medium for the cleaning purpose. During the long recovery time, the toner collecting roller can collect even the toner particles which have entered the core region of the brush. As a consequence, the cleaning power of the fur brush is recovered to such an extent that the fur brush is always put into use in an almost new or fresh state, so that the fur brush can stand a long use without suffering from any degradation in the cleaning effect.

It is, however, often experienced that the color print produced by an apparatus incorporating a fur brush of the type described above is defective particularly when the humidity of the ambient air is high. This is attributable to the fact that, when the humidity of the air is high, the efficiency of the transfer of the toner from the photosensitive medium to the paper is lowered, resulting in a cleaning failure. The inventors have confirmed that the toner remaining on the photosensitive medium has been negatively charged by the negative transferring corona through the paper the resistance value of which has been reduced due to absorption of moisture. Such negatively charged toner cannot be removed by the fur brush which is charged so as to attract positively charged toner.

The reduction in the cleaning effect would be compensated for to some extent by the use of air suction in the fur brush. Such a system, however, produces an impractically high level of noise and, hence, is not preferred.

According to the invention, the negatively charged toner is charged into the original polarity by a corona charger before the photosensitive medium is cleaned, so that the toner is electrostatically attracted by the conductive fur brush. As a consequence, the toner can be completely removed by the fur brush even when the transfer efficiency is low due to high humidity of the ambient air.

The corona charging of the negatively-charged toner into the original polarity may be effected by the main charger through one full rotation of the photosensitive medium or, alternatively, by an auxiliary charger which is located downstream from the transfer charger but upstream of the fur brush cleaner. Thus, according to the invention, it is possible to obtain a color electrophotographic apparatus which is capable of producing a clear color copy image without any substantial degradation, as well as a color electrophotographic apparatus having a cleaning device which exhibits a high cleaning power with reduced level of noise and which has a reduced size.

Other features of the present invention will become clear from the following description of the embodiments.

Preferably, the fur brush used in the cleaning device of the invention is made of a conductive material. Any conductive fibers such as acrylic fibers with carbon black dispersed therein, conductive polymeric compounds, carbon fibers and metallic fibers can be used conveniently. The conductive material should have a resistivity which preferably ranges between $10^4$ to $10^{12}$ Ωcm.

Figure 3:
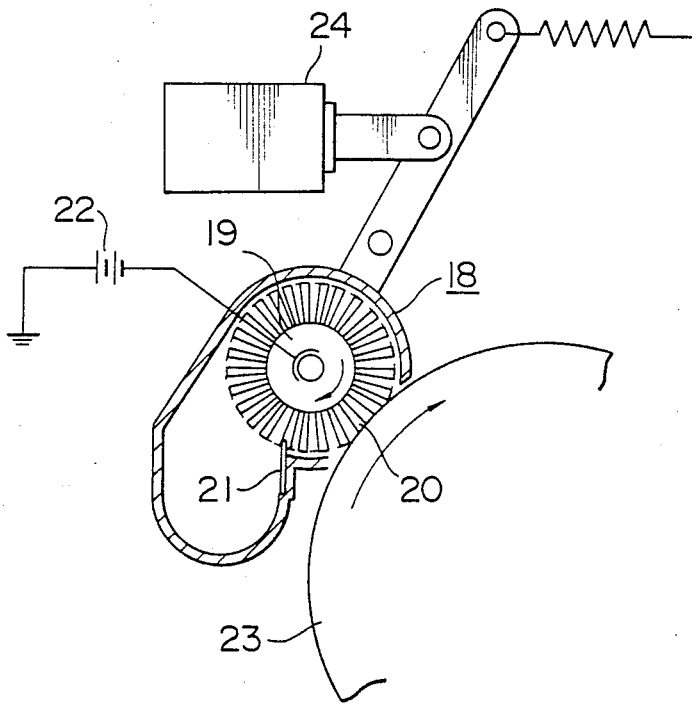
FIG. 3 is an illustration of the basic arrangement of an embodiment of the cleaning device of the present invention.

The construction of a cleaning device in accordance with the present invention will be explained hereinunder with specific reference to FIG. 3. The fur brush, which is generally designated by a numeral 18, is constituted by a conductive roller 19 and a conductive fur 20 fixed to the surface of the conductive roller 19. The fur brush 18 may be formed by winding on the roller 19 a woven fabric with the fur 20 planted thereon. The fur may be directly planted on the roller 19 electrostatically. A scraper plate 21 is held in contact with the fur brush 18 so as to scrape the toner collected by and attaching to the fur brush 18. A high-voltage D.C. power supply 22 is connected to the fur brush 18 so as to apply a D.C. voltage directly to the fur brush 18. The cleaning device also is provided with a driving solenoid 24 which operates to keep the fur brush 13 in contact with a photosensitive medium 23 during cleaning and to keep the same away from the photosensitive medium 23 when the cleaning is not conducted. During the cleaning, the fur brush 18 is pressed onto the photosensitive medium 23 and is rotated at a peripheral speed which is 1.5 to 3 times as high as that of the photosensitive medium, in the direction opposite to the direction of movement of the surface of the photosensitive medium 23.

Preferably, the D.C. voltage applied to the fur brush 18 is of the reverse polarity to that of the charged toner on the photosensitive medium, so that the toner is electrostatically adsorbed by the fur brush 18, thus ensuring a high cleaning effect. The level of the D.C. voltage applied to the fur brush preferably ranges between −100 and −600 V. In particular, in order to completely eliminate the residue of the bulk of toner on the photosensitive medium which tends to occur after the separation of the fur brush, it is recommended to continue the application of the voltage to the fur brush even when the fur brush is being moved out of contact with the photosensitive medium. It is also advisable to keep the rotation of the fur brush not only during cleaning but also when the brush is kept apart from the photosensitive medium, because the elimination of residue of the bulk of toner after separation of the brush is further ensured by such an operation.

Figure 4:
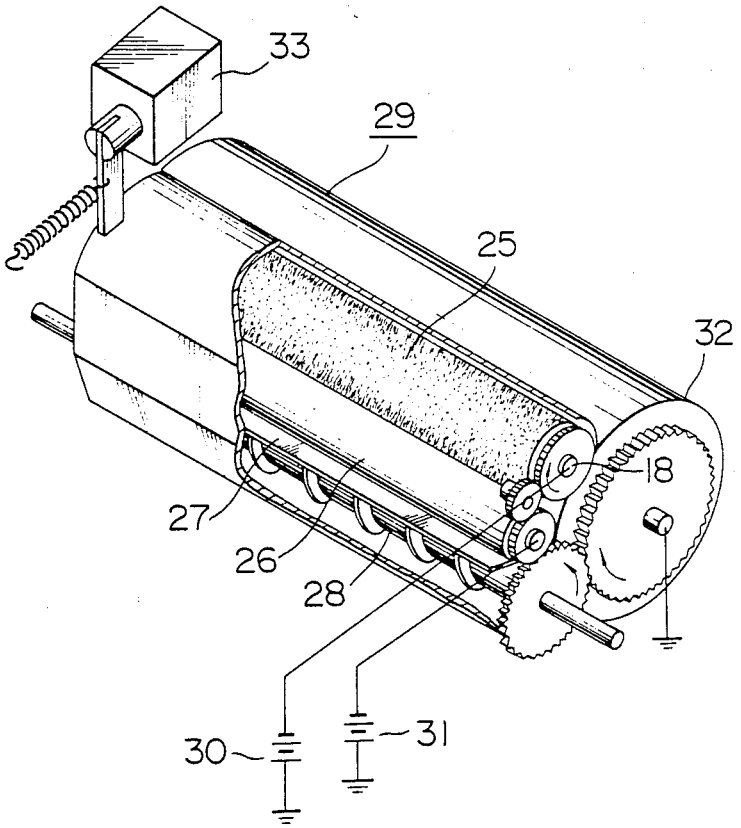
FIG. 4 is an illustration of the basic arrangement of an improved cleaning device in accordance with the present invention.

Another cleaning device of the invention having improved cleaning effect will be explained with specific reference to FIG. 4. This cleaning device has a conductive toner collecting roller 26 which is held in contact with the fur brush 25 and a scraper plate 27 which is held in contact with the collecting roller 26 so as to scrape the toner off the collecting roller 26. The scraped toner is swept out by means of a screw 28.

The collecting roller 26 is preferably made of a conductive material such as a metal, while a rubbery material such as urethane rubber and silicon rubber, as well as a metal such as phosphor bronze and stainless steel, can be used as the material of the scraper plate 27.

In this embodiment, the fur brush 25, the collecting roller 26, the scraper plate 27 and the discharge screw 28 are assembled together so as to form a cleaning unit 29. High-voltage D.C. power supplies 30 and 31 are connected to the fur brush 25 and the collecting roller 26 so as to apply D.C. voltages thereto. The cleaning device further includes a driving solenoid 33 which is adapted to press the cleaning unit into contact with the photosensitive medium 32 and to keep the unit 29 away from the photosensitive medium 32 when the cleaning is not being conducted. During the cleaning, the fur brush 25 is pressed onto the surface of the photosensitive medium 32 and is rotated at a peripheral speed which is 1.5 to 3 times as high as that of the photosensitive medium 32 in the direction opposite to the direction of movement of the surface of the photosensitive medium 32. At the same time, the collecting roller 26 is rotated at a peripheral speed which is 1.5 to 3 times as high as that of the fur brush 25, in the direction opposite to the direction of movement of the surface of the latter.

Preferably, the power supply 30 supplies the fur brush 25 with a D.C. voltage which is reverse to that of the charged toner on the photosensitive medium. The D.C. voltage of such a polarity applied to the photosensitive medium enables the fur brush 25 to electrostatically attract the toner on the photosensitive medium 32, thus offering a higher cleaning effect. When the toner on the photosensitive medium has been charged positively, the D.C. voltage applied to the fur brush 25 preferably ranges between −100 and −600 V with respect to the potential of the surface of the photosensitive medium 32. In order to enable the collecting roller 26 to electrostatically attract the toner from the fur brush 25, the power supply 31 supplies the collecting roller 26 with a voltage of the polarity reverse to that of the toner on the photosensitive medium and having an absolute value which is greater than that of the voltage applied to the fur brush 25. More specifically, the D.C. voltage applied to the collecting roller 26 preferably ranges between −100 and −600 V with respect to the potential of the fur brush 25. Thus, when the voltage applied to the fur brush 25 is −300 V, the voltage applied to the collecting roller 26 preferably ranges between −400 and −900 V. An aprreciable effect for removing the toner from the fur brush 25 can be attained by continuing the movement of the surface of the collecting roller 26 while applying the D.C. voltage thereto. In case of high-speed copying process, however, the collecting roller often fails to remove the toner completely. In such a case, the fur brush 25 is moved away from the photosensitive medium 32 after the cleaning and is rotated in the direction opposite to the direction of movement of the surface of the photosensitive medium at a peripheral speed which is 1.5 to 3 times as high as the peripheral speed of the medium, while the collecting roller 26 is rotated in the direction opposite to the direction of movement of the surface of the fur brush 25 at a peripheral speed which is 1.5 to 3 times as high as the peripheral speed of the fur brush 25. Meanwhile, the power supply 30 applies a voltage of 0 to −600 V to the fur brush 25. In order to enable the collecting roller 26 to electrostatically attract the toner, the power supply 31 supplies the collecting roller 26 with a voltage of the polarity reverse to that of the toner and of an absolute value greater than that of the voltage applied to the fur brush 25. For instance, when the toner is positively charged, the relative voltage applied to the collecting roller 26 is from −100 to −600 V with respect to the potential of the fur brush 25. Thus, the voltage applied to the collecting roller is −100 to −600 V when the fur brush 25 is grounded. By continuing the rotation of the fur brush and the toner collecting roller 26 while applying these voltages, it is possible to completely remove the toner from the fur brush and, hence, to eliminate any reduction in the cleaning power even in the high-speed process.

EXAMPLE 1

Figure 5:
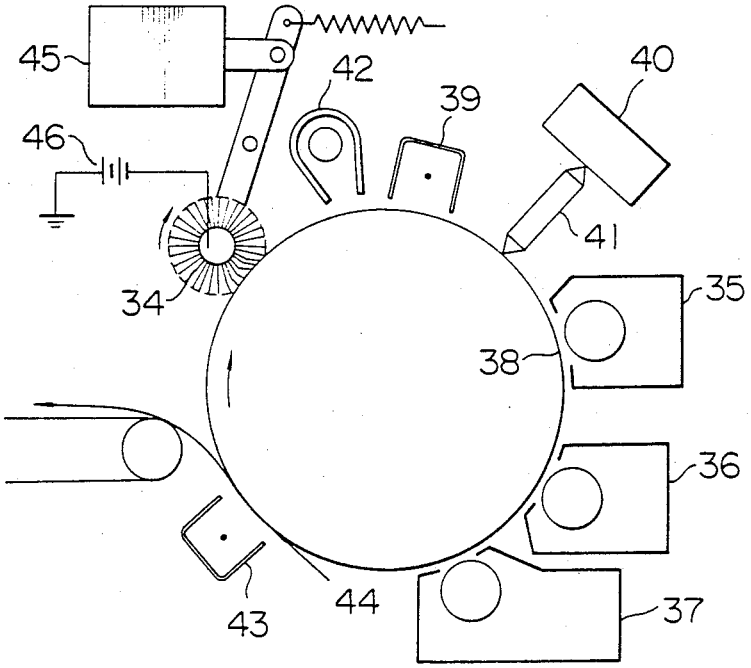
FIG. 5 is an illustration of the principle of operation of a color electrophotographic printer as an embodiment of a multi-color printing apparatus of the invention.

A practical example of the invention will be explained in connection with FIG. 5.

A fur brush 34 was formed by planting, on a stainless steel roller of 10 mm diameter, a fur of acrylic fibers with carbon dispersed therein (resistivity $10^5$ Ωcm, length of brush fibers 4 mm, size of wire 10 denier and density 3600 fibers per $cm^2$).

Aluminum rollers were used as toner carriers 35, 36 and 37, and thin layers of toner were formed on the surfaces of the toner carriers by means of blades and the toner carriers were positioned to oppose photosensitive medium 38 leaving a gap therebetween. Three types of toners Y, M and C were used. The specifications of the toner carriers and the developing conditions were as follows.

Specifications of Toner Carriers and Developing Conditions

Diameter: 16 mm

Peripheral speed: 75 mm/sec
Thickness of toner layer on toner carrier: 30 μm
Direction of movement of peripheral surface: same as photosensitive body 38
Distance from photosensitive medium: 150 μm during development and 700 μm when not developing
Developing bias: +600 V during development and 0 V when not developing Specifications of Toner Amount of charge on toner: +3μC/g
Mean particle size: 10 μm An amorphous Se—Te photosensitive drum 38 of 100 mm diameter was rotated at a peripheral speed of 75 mm/sec, while charging the surface of the drum to a potential off +800 V by a charger 39 (corona voltage +7 KV). A light-emitting diode 40 having an output power of 7 μW and wavelength of 670 nm was activated to expose the photosensitive drum 38 to yellow signals through a rod lens array 41, thus forming an electrostatic latent image. Subsequently, the photosensitive drum surface was made to pass through a yellow toner carrier 35 under developing condition so that the latent image was developed with the yellow toner. The surface of the photosensitive drum then passed by the magenta toner carrier 36 and the cyan toner carrier 37 which were not in the developing condition. The toner image on the photosensitive drum 38 was not transferred to a paper in this stage, but the whole surface was irradiated with a charge eliminating lamp 42 and then charged again by a corona charger 39.

Then, the photosensitive drum 38 was exposed to a signal light corresponding to magenta from the light-emitting diode 40 and the surface of the drum was made to pass by the magenta toner carrier 36 under the developing condition past the yellow toner carrier 35 under the non-developing condition, so that the latent image corresponding to the magenta color was developed by the magenta toner. The surface of the photosensitive drum then passed by the cyan toner carrier 37 under non-developing condition. After the development by the magenta color, the whole surface of the photosensitive drum 38 was irradiated with the light from the charge eliminating lamp 42 so as to erase the electrostatic latent image and was then charged by the corona charger 39.

Then, the photosensitive drum 38 was exposed to a signal light corresponding to cyan from the light-emitting diode 40 and the surface of the drum was made to pass by the cyan toner carrier 37 under the developing condition past the yellow toner carrier 35 and the magenta toner carrier 36 under the non-developing condition, so that the latent image corresponding to the cyan color was developed by the cyan toner. The color toner images thus formed on the photosensitive drum 38 were transferred to a sheet of paper 44 by a transfer charger 43 and was then thermally fixed.

After the completion of the transfer of the color images, the charges on the photosensitive drum 38 were eliminated by the charge eliminator 42, and a fur brush 34 was pressed onto the photosensitive medium 38 by means of the driving solenoid 45, for the purpose of cleaning. More specifically, the fur brush 34 was rotated at a peripheral speed of 150 mm/sec and was supplied with a D.C. voltage of −300 V from a D.C. power supply 46, while being pressed onto the photosensitive drum 38 by the driving solenoid 45. After the cleaning, the driving solenoid 45 was activated again to move the fur brush 34 away from the photosensitive element 38. When the fur brush 34 is moved apart from the photosensitive drum 38, both the rotation of the fur brush 34 and the application of the voltage were continued. As a consequence, all the toner on the photosensitive drum 38 was removed. It was also confirmed that no bulk nor line was left on the portion of the surface of the photosensitive drum 38 at which the fur brush 34 left the photosensitive drum 38.

The color copy image thus obtained exhibited a maximum density which was as high as 1.7, as well as superior colors without contamination. The color purity was not degraded and no substantial contamination of color was observed even after 30,000 successive copying cycles.

COMPARISON EXAMPLE 1

Color printing was conducted with the same copying apparatus and the same copying method as Example 1. However, a cleaning device incorporating a known acrylic fiber fur brush (30 mm diameter and rotated in the direction opposite to the direction of movement of the surface of the photosensitive drum 38 at 1880 mm/sec) with air sucking function was used in place of the conductive fur brush cleaner supplied with D.C. voltage. In this case, a bulk of toner and a line of toner were left on the surface of the photosensitive drum 38 after the separation of the fur brush cleaner, as in the case of the apparatus employing a conventional blade cleaner, and toners of colors other than yellow were undesirably introduced into the toner carrier 35. As a consequence, degradation of the color purity was started from the early stages of 20 successive copying cycles.

EXAMPLE 2

Figure 6:
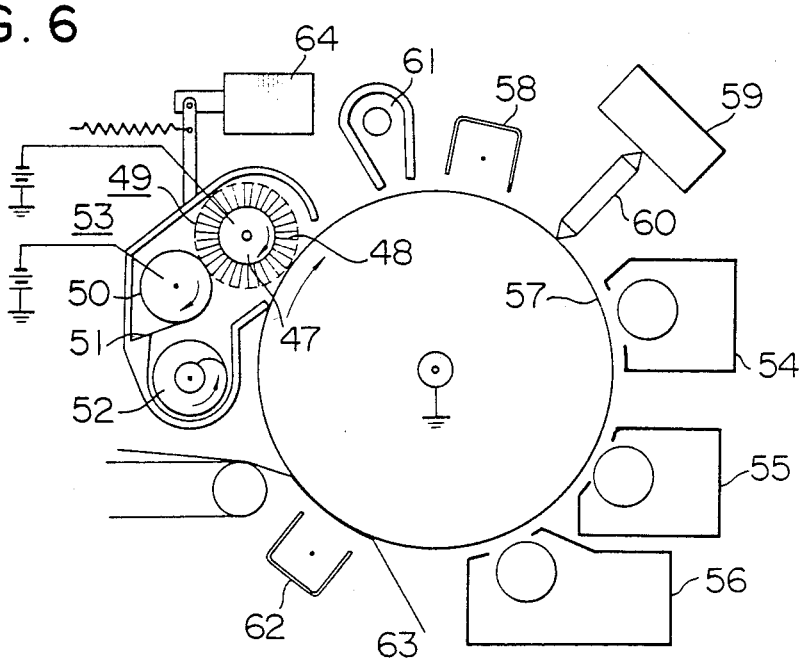
FIG. 6 is an illustration of the principle of operation of a color electrophotographic printer as an improved embodiment of a multi-color printing apparatus of the invention.

An improved practical example of the invention will be explained in connection with FIG. 6.

A fur brush 49 was formed by planting, on a stainless steel roller 47 of 10 mm diameter, a fur of acrylic fibers with carbon dispersed therein (resistivity $10^5$ Ωcm, length of brush fibers 4 mm, size of fibers 10 denier and density 3600 fibers per $cm^2$).

A toner collecting roller 50 (20 mm diameter) made of aluminum was held in contact with the fur brush 49 over a contact width of 1 mm and a blade 51 made of phosphor bronze was placed in contact with the collecting roller 50. A screw 52 was disposed so as to be able to sweep out the toner scraped by the blade 51. The fur brush 49, toner collecting roller 50, the blade 51 and the discharge screw 52 were assembled together so as to form a cleaning unit 53.

Aluminum rollers were used as toner carriers 54, 55 and 56, and thin layers of toner were formed on the surfaces of the toner carriers by means of blades and the toner carriers were positioned to oppose the photosensitive medium 57 leaving a gap therebetween. Three types of toners Y, M and C were used. The specifications of the toner carriers and the developing conditions were as follows.

Specifications of Toner Carriers and Developing Conditions

Diameter: 16 mm
Peripheral speed: 150 mm/sec
Thickness of toner layer on toner carrier: 30 μm
Direction of movement of peripheral surface: same as photosensitive body 38

Distance from photosensitive medium: 150 μm during development and 700 μm when not developing
Developing bias: +600 V during development and 0 V when not developing Specifications of Toner Amount of charge on toner: +3μC/g
Mean particle size: 10 μm An amorphous Se—Te photosensitive drum 57 of 100 mm diameter as the photosensitive medium was rotated at a peripheral speed of 150 mm/sec, while charging the surface of the drum to a potential of +800 V by a charger 58 (corona voltage +7 KV). A light-emitting diode 59 having an output power of 7 μW and wavelength of 670 nm was activated to expose the photosensitive drum 57 to yellow signals through a rod lens array 60, thus forming an electrostatic latent image. Subsequently, the photosensitive drum surface was made to pass through the yellow toner carrier 54 under developing condition so that the latent image was developed with the yellow toner. The surface of the photosensitive drum then passed by the magenta toner carrier 55 and the cyan toner carrier 56 which were not in the developing condition. The toner image on the photosensitive drum 57 was not transferred to a paper in this stage, but the whole surface was irradiated with a charge eliminating lamp 61 and then charged again by a corona charger 59.

Then, the photosensitive drum 38 was exposed to a signal light corresponding to magenta from the light-emitting diode 59 and the surface of the drum was made to pass by the magenta toner carrier 55 under the developing condition past the yellow toner carrier 54 under the non-developing condition, so that the latent image corresponding to the magenta color was developed by the magenta toner. The surface of the photosensitive drum then passed by the cyan toner carrier 56 under non-developing condition. After the development by the magenta color, the whole surface off the photosensitive drum 57 was irradiated with the light from the charge eliminating lamp 61 so as to erase the electrostatic latent image and was then charged by the corona charger 58.

Then, the photosensitive drum 38 was exposed to a signal light corresponding to cyan from the light-emitting diode 59 and the surface of the drum was made to pass by the cyan toner carrier 56 under the developing condition past the yellow toner carrier 54 and the magenta toner carrier 55 under the non-developing condition, so that the latent image corresponding to the cyan color was developed by the cyan toner. The color toner images thus formed on the photosensitive drum 38 were transferred to a sheet of paper 63 by a transfer charger 62 and was then thermally fixed.

After removing the electrostatic charge from the surface of the photosensitive drum 57 by the charge eliminator 61, the cleaning unit 53 was pressed onto the photosensitive drum 57 by the action of the driving solenoid 64 so as to clean the photosensitive drum 57. The operating conditions of the fur brush 49 and the collecting roller 50 were as follows.

Fur brush 49

Voltage applied: −300 V
Peripheral speed: 225 mm/sec
Direction of movement of peripheral surface: Opposite to photosensitive drum 57

Collecting roller 50

Voltage applied: −600 V
Peripheral speed: 450 mm/sec
Direction of movement of peripheral surface: Opposite to fur brush 49

As a consequence, the toner on the photosensitive drum was attracted by the fur brush 49 and a part of the thus attracted toner was collected by the collecting roller 50. After this cleaning operation, the driving solenoid 64 was operated again to move the cleaning unit 53 away from the photosensitive drum 57 and the next printing cycle was started. In this state, the operating conditions of the fur brush 49 and the collecting roller 50 were as follows.

Fur brush 49

Voltage applied: 0 V
Peripheral speed: 225 mm/sec
Direction of movement of peripheral surface: Opposite to photosensitive drum 57

Collecting roller 50

Voltage applied: −300 V
Peripheral speed: 450 mm/sec
Direction of movement of peripheral surface: Opposite to fur brush 49

As a result, the toner accumulated on the fur brush 49 was progressively removed by the collecting roller 50 during the movement of the cleaning unit away from the photosensitive drum, so that no substantial reduction in the cleaning effect was observed during cleaning after the next copying cycle. In addition, no fogging was confirmed even when the transfer efficiency was lowered in air of high relative humidity of 80%.

The color copy image thus obtained exhibited a maximum density which was as high as 1.7, as well as superior colors without contamination. The color purity was not degraded and no substantial contamination of color was observed even after 30,000 successive copying cycles.

EXAMPLE 3

Figure 7:
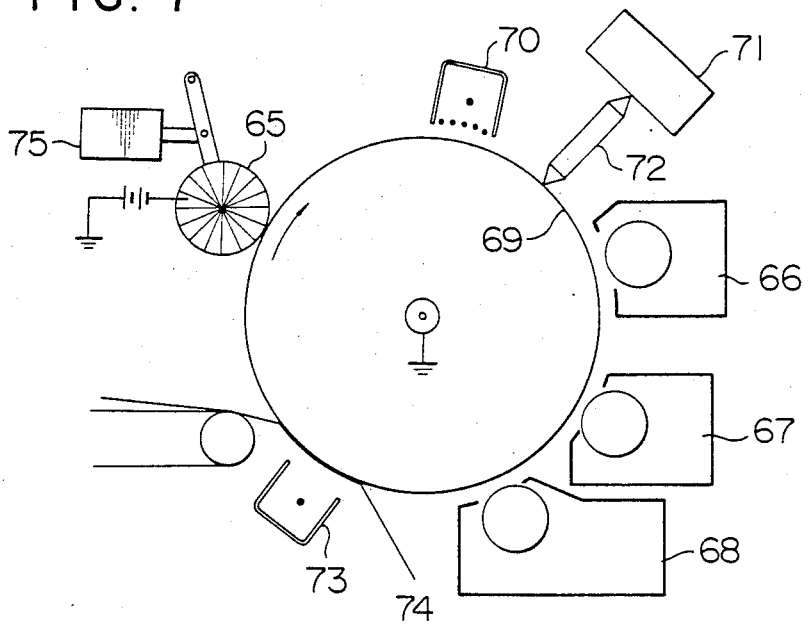
FIG. 7 is an illustration of the principle of operation of a color electrophotographic printer as another improved embodiment of a multi-color printing apparatus of the invention.

An improved practical example of the invention will be explained in connection with FIG. 7.

A fur brush 65 was formed by winding, on a stainless steel roller of 10 mm diameter, a belt of fur of acrylic fibers with carbon dispersed therein (resistivity $10^5$ Ωcm, length of brush fibers 4 mm, size of fibers 10 denier and density 3600 fibers per $cm^2$).

The apparatus used in Example incorporated developing devices 66, 67 and 68 which are of non-contact non-magnetic mono-component type capable of causing the toner to fly under application of a D.C. electric field. Each developing device had an aluminum developing roller on which a thin layer of toner is formed by means of a blade. More specifically, the developing devices 66, 67 and 68 contained toners of yellow (Y), magenta (M) and cyan (C), respectively. The developing devices were disposed around a photosensitive drum 69 such that a constant developing gap is formed between each developing roller and the photosensitive drum 69. Each developing device is provided with a driving mechanism for driving the developing device between a developing position in the vicinity of the photosensitive drum 69 and a non-developing position away from the same. The specifications of the developing device, developing conditions and the physical properties of the toner were the same as those in Example 2.

The amorphous Se—Te photosensitive drum 69 of 100 mm diameter as the photosensitive medium was rotated at a peripheral speed of 150 mm/sec, while charging the surface of the drum to a potential of +700 V by a charger 58 (corona voltage +7 KV, grid voltage +850 V). A light-emitting diode 71 having an output power of 7 μW and wavelength of 670 nm was activated to expose the photosensitive drum 69 to yellow signals through a rod lens array 72, thus forming an electrostatic latent image. Subsequently, the latent image was developed by the yellow developing device 66 which was held in the developing condition. The surface of the photosensitive drum then passed by the magenta developing device 67 and the cyan developing device 68 which were not in the developing condition. The photosensitive drum 69 carrying the Y toner image was charged again by a charger 70 to a surface potential of +850 V.

Then, the photosensitive drum 69 was exposed to a signal light corresponding to magenta from the light-emitting diode 71 and the surface of the drum was made to pass by the magenta developing device 67 under the developing condition past the yellow developing device 66 under the non-developing condition, so that the latent image corresponding to the magenta color was developed by the magenta toner. The surface of the photosensitive drum then passed by the cyan developing device 68 under non-developing condition. The photosensitive drum 69 after the development by the magenta color was charged again to the surface potential of 850 V by the charger 70.

Then, the photosensitive drum 69 was exposed to a signal light corresponding to cyan from the light-emitting diode 71 and the surface of the drum was made to pass by the cyan developing device 68 under the developing condition past the yellow developing device 66 and the magenta developing device 68 under the nondeveloping condition, so that the latent image corresponding to the cyan color was developed by the cyan toner. The color toner images of Y, M and C colors thus formed on the photosensitive drum 69 were transferred to a sheet of paper 74 by a transfer charger 73 and was then thermally fixed. The transfer efficiency was about 80%. After the transfer, a certain portion of the toner was left on the photosensitive drum 69. The toner remaining on the photosensitive drum 69 had been charged negatively, i.e., to the polarity opposite to the initial polarity. Then, the driving solenoid 75 was activated to press the fur brush 65 onto the surface of the photosensitive drum 69 so as to remove the toner remaining on the latter. This cleaning operation was conducted under the following condition.

Voltage applied: −300 V
Peripheral speed: 225 mm/sec
Direction of movement of peripheral surface: Opposite to photosensitive drum 69

As a consequence, most part of the toner remaining on the photosensitive drum 69 was removed by the fur brush 65 but a small part of the toner which had been negatively charged was left unremoved. Then, the toner still remaining on the photosensitive drum was positively charged by the charger 70 and the surface of the photosensitive drum 69 was made to pass through the cleaning device once more. In consequence, the toner on the photosensitive drum 69 was completely attracted and collected by the fur brush 65. After the completion of this cleaning operation, the driving solenoid 75 was operated again to move the fur brush 65 from the photosensitive drum 69 and the next printing cycle was commenced.

The color copy image thus formed exhibited a maximum density as high as 1.7 and a high quality without substantial color contamination. No deterioration in the cleaning power nor fogging was observed even after 30,000 repetitional printing cycles.

Thus, in this Example, a color print of a high quality was obtained without suffering from any contamination of the matrix in each of the successive cycles, by virue of the operation for charging the toner remaining on the photosensitive drum to a proper polarity. In addition, no cleaning failure was observed even when the relative humidity of air was as high as 80%.

This Example is suitable for use particularly in the case where the polarity of charging of the toner is the same as that of the photosensitive drum 69, i.e., when the copy image is obtained through a negative to positive inversion.

It is to be noted also that this Example enables the production cost and the size of the apparatus to be reduced, because the charger used for the purpose of charging the photosensitive drum is utilized also as the charger for charging the toner on the photosensitive drum to the initial polarity.

EXAMPLE 4

Figure 8:
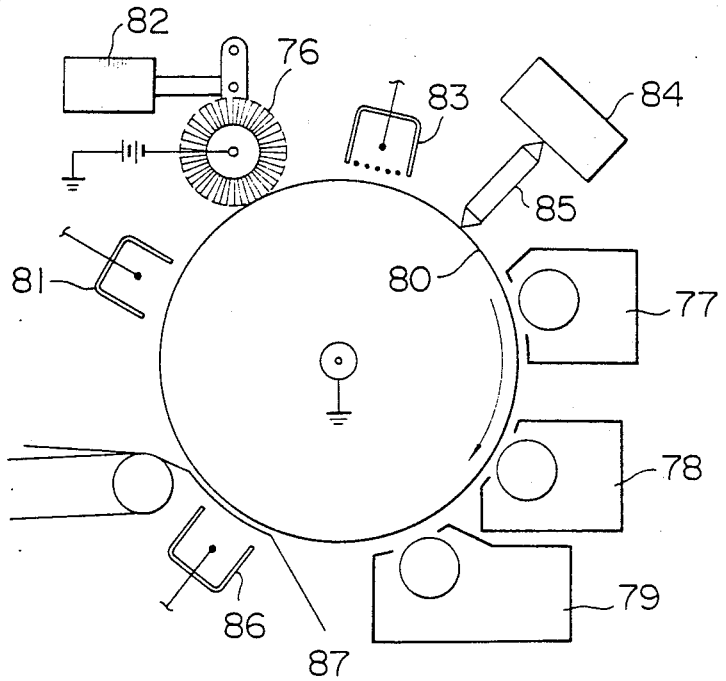
FIG. 8 is an illustration of the principle of operation of a color electrophotographic printer as a further improved embodiment of a multi-color printing apparatus of the invention.

A further improved practical example of the invention will be explained in connection with FIG. 8.

A fur brush 76 was formed by planting, on a stainless steel roller of 10 mm diameter, a fur of acrylic fibers with carbon dispersed therein (resistivity $10^5$ Ωcm, length of brush fibers 4 mm, size of fibers 10 denier and density 3600 fibers per $cm^2$).

In this case, aluminum rollers were used as the developing devices 77, 78 and 79, and thin layers of toners were formed on respective developing devices by means of blades (not shown). The developing devices were positioned to oppose to the photosensitive drum 80 leaving predetermined gaps therebetween. Ordinary nonmagnetic toners with dispersion of pigments in a resin binder were used as the toners of Y, M and C colors. The constructions of the developing devices and the specifications of the toners were the same as those used in Example 2.

Construction of Developing Device and Developing Conditions

The amorphous Se—Te photosensitive drum 80 of 100 mm diameter as the photosensitive medium was rotated at a peripheral speed of 150 mm/sec, and was charged to a surface potential of +500 V by an auxiliary charger 81 (corona voltage +5 KV). Then, a fur brush 76 was pressed onto the photosensitive drum 80 by the solenoid 82.

Cleaning Conditions of Fur Brush 76

Voltage applied: −300 V
Peripheral speed: 225 mm/sec
Direction of Movement of Peripheral Surface: Opposite to photosensitive drum 80

Due to the contact between the fur brush 76 and the photosensitive drum 80, the surface potential of the photosensitive drum 80 was reduced substantially to 0 V. Then, the photosensitive drum 80 was charged to a surface potential of +700 V by a main charger 83

(scorotron charger having corona voltage of +7 kV and grid voltage of +850 V). A light-emitting diode 84 having an output power of 7 μW and wavelength of 670 nm was activated to expose the photosensitive drum 80 to yellow signals through a rod lens array 85, thus forming an electrostatic latent image. Subsequently, the latent image was developed by the yellow developing device 77 which was held in the developing condition. The surface of the photosensitive drum then passed by the magenta developing device 78 and the cyan developing device 79 which were not in the developing condition. The photosensitive drum 80 carrying the Y toner image was charged by the auxiliary charger 81 to a potential of +750 V, and was made to pass by the cleaning device which had been kept away from the photosensitive drum 80. Then, the surface of the photosensitive drum 80 was charged again to +800 V by the main charger 83. Then, the photosensitive drum 80 was exposed to a signal light corresponding to magenta from the light-emitting diode 84 and the surface of the drum was made to pass by the magenta developing device 78 under the developing condition past the yellow developing device 77 under the nondeveloping condition, so that the latent image corresponding to the magenta color was developed by the magenta toner. The surface of the photosensitive drum then passed by the cyan developing device 79 under non-developing condition. The photosensitive drum 80 after the development by the magenta color was charged again to the surface potential of +850 V by the auxiliary charger 81 and, after passing by the cleaning device kept away from the photosensitive drum 80, charged up to +880 V by the main charger 83.

Then, the photosensitive drum 80 was exposed to a signal light corresponding to cyan from the light-emitting diode 84 and the surface of the drum was made to pass by the cyan developing device 79 under the developing condition past the yellow developing device 77 and the magenta developing device 78 under the non-developing condition, so that the latent image corresponding to the cyan color was developed by the cyan toner. The color toner images of Y, M and C colors thus formed on the photosensitive drum 80 were transferred to a sheet of paper 87 by a transfer charger 86 and was then thermally fixed. The transfer efficiency was about 80%. After the transfer, a certain portion of the toner was left on the photosensitive drum 80. The toner remaining on the photosensitive drum 69 had been charged negatively, i.e., to the polarity opposite to the initial polarity. The toner still remaining on the photosensitive drum was positively charged by the auxiliary charger 81 and was then subjected to a cleaning operation which was conducted under the following condition.

Voltage applied: −300 V
Peripheral speed: 225 mm/sec
Direction of movement of peripheral surface: Opposite to photosensitive drum 80

As a consequence, the toner on the photosensitive drum 80 was completely attracted and collected by the fur brush 76. After the completion of this cleaning operation, the driving solenoid 82 was operated again to move the fur brush 76 away from the photosensitive drum 80 and the next printing cycle was commenced.

Thus, in this Example, no reduction in the cleaning effect is caused in the cleaning operation after the next printing operation, by virtue of the provision of the auxiliary charger 81 upstream of the cleaning device. In addition, no cleaning failure was observed even when the relative humidity of air was as high as 80%.

This Example is suitable for use particularly in the case where the polarity of charging of the toner is the same as that of the photosensitive drum 69, i.e., when the copy image is obtained through a negative to positive inversion.

In this Example, the auxiliary charger 81 has not only the function for charging the toner remaining on the photosensitive drum 80 to the same polarity as the drum 80 but also a function for assisting the main charger 83 in charging the photosensitive drum. Therefore, the auxiliary charger is preferably operated regardless of whether the cleaning device is used or not.

If the potential of the photosensitive drum charged by the auxiliary charger 81 becomes higher than the desired surface potential, it becomes difficult to lower the surface potential down to the desired level by the operation of the main charger 83. It is, therefore, critical that the charging of the photosensitive drum 80 by the auxiliary charger 81 is made up to a potential below the desired potential to be obtained and then the charging is effected by the main charger 83 up to the desired potential.

It is to be understood also that, in order to stably obtain copy image of a high quality, the surface potential of the photosensitive drum has to be maintained constant. From this point of view, the main charger 83 is preferably a scorotron charger which enables the surface potential to be controlled easily.

The color image thus formed exhibited a maximum density as high as 1.7 and a superior quality of the copy image without no degradation in the purities of colors. No reduction in the cleaning power nor fogging was observed even after 30,000 repetitional printing cycles.

It is to be understood also that the use of the auxiliary charger 81 enables photosensitive mediums of materials which tend to exhibit optical memory or materials which are rather difficult to charge, e.g., selenium-arsenic alloy ($As_2Se_3$) to be used in a high-speed process without any risk that the photosensitive drum exhibit a too low surface potential.

What is claimed is:

1. A color electrophotographic apparatus, comprising:

a photosensitive medium;

a main corona-charger for applying a charge to said photosensitive medium before exposure thereof;

exposure means for exposing said photosensitive medium after a charge is applied thereto by said main corona-charger;

a plurality of developing units each having toner of a different color for developing toner images on said photosensitive medium with toner in different colors;

an image transfer unit for transferring a toner image formed on said photosensitive medium;

a fur brush which is electrically conductive for cleaning the surface of said photosensitive medium;

a drive mechanism for moving said fur brush into contact with said photosensitive medium during cleaning and for moving said fur brush out of contact with said photosensitive medium when cleaning is not conducted;

a D.C. power supply for supplying a D.C. voltage to said fur brush; and a corona-charger disposed upstream of said fur brush but downstream of said image transfer unit, for applying a charge to said photosensitive medium after the transfer of the toner images so that toner remaining on said photosensitive medium is uniformly corona-charged.

2. A method of cleaning a photosensitive medium in a color electrophotographic apparatus in which said photosensitive medium is adapted to be rotated and subjected to repetitions of toner image formation in different colors, said apparatus further comprising a corona-charger for applying a charge to said photosensitive medium; exposure means for exposing said photosensitive medium; a plurality of developing units each having toner of different colors for developing toner images on said photosensitive medium with said toner of different colors an image transfer unit for transferring thus developed toner images from said photosensitive medium onto an image bearing medium; a fur brush which is electrically conductive for cleaning said photosensitive medium; an electrical power source for applying a voltage to said fur brush; means for collecting toner from said fur brush; and cleaning means including a mechanism for moving said fur brush into contact with said photosensitive medium during a period of cleaning said photosensitive medium and for moving said fur brush out of contact with said photosensitive medium during a period other than the cleaning period, said method of cleaning a photosensitive medium comprising the steps of:

applying a corona-charge to said photosensitive medium after said toner images are transferred from said photosensitive medium to said image bearing medium so that toner remaining on said photosensitive medium is charged with a uniform polarity; and cleaning said photosensitive medium after same has been corona-charged, by means of said fur brush by applying a D.C. voltage to said fur brush using said electrical power source and contacting said fur brush with said photosensitive medium by means of said mechanism for moving said fur brush.

3. The method as set forth in claim 2, wherein said means for collecting toner includes a toner collecting roller which is conductive and adapted to make contact with said fur brush, and wherein a D.C. voltage, relative to said D.C. voltage applied to said fur brush, is applied to said conductive roller.

4. The method as set forth in claim 2, wherein said fur brush has a resistivity ranging between $10^4$ and $10^{12}$ Ωcm.

5. The method as set forth in claim 4, wherein said D.C. voltage is applied to said fur brush with a polarity reverse to that of said photosensitive medium.

6. The method as set forth in claim 5, wherein said D.C. voltage is applied to said brush at least when said fur brush is being moved into and out of contact with said photosensitive medium.

7. The method as set forth in claim 3, wherein said D.C. voltage applied to said toner collecting roller has a polarity reverse to that of said photosensitive medium and is higher than the voltage of said fur brush.

8. The method as set forth in claim 3, wherein said corona-charger has a polarity which is the same as that of said photosensitive medium.

9. The method as set forth in claim 2, wherein said fur brush is rotated at least when it is being moved into and out of contact with said photosensitive medium.

10. The method as set forth in claim 3, wherein said means for collecting toner is operated when said brush is moved out of contact with said photosensitive medium.

11. The method as set forth in claim 7, wherein said means for collecting toner is operated in association with the rotation of both of said fur brush and said toner collecting roller.

12. The method as set forth in claim 8, wherein said means for collecting toner is adapted to apply a voltage between said fur brush and said toner collecting roller.

13. The method as set forth in claim 2, wherein said photosensitive medium has a surface which moves in a first direction and wherein said fur brush is moved in a direction opposite to said first direction.

14. The method as set forth in claim 2, wherein said fur brush is in contact with a scraper member.

15. The method as set forth in claim 2, wherein said corona-charger is a scorotron charger.

16. The method as set forth in claim 2, wherein said corona-charger operates regardless of whether said fur brush is in contact with the said photosensitive medium.

17. The method as set forth in claim 13, wherein said photosensitive medium is corona-charged to a first potential before exposure thereof and wherein said photosensitive medium is corona-charged, before cleaning of said photosensitive medium, to a second potential, which second potential is lower than said first potential.

* * * * *